US005870922A

United States Patent [19]

Rodriguez et al.

[11] Patent Number: 5,870,922

[45] Date of Patent: Feb. 16, 1999

[54] PROCESS AND SYSTEM OF CALCULATION FOR CONSTRUCTION OF DIES FOR EXTRUSION OF SOLID ALUMINUM PROFILES

[76] Inventors: Primitivo Rodriguez, Calle Valle De Bielsa, Buzon 196 Las Lomas Del Gallego 50800 Zuera, Spain; Alcibiades Rodriguez, 2678 Meadowood Dr., Ft. Lauderdale, Fla. 33332

[21] Appl. No.: 806,053

[22] Filed: Feb. 25, 1997

Related U.S. Application Data

[63] Continuation of Ser. No. 438,353, May 10, 1995, abandoned, which is a continuation-in-part of Ser. No. 47,292, Apr. 19, 1993, abandoned.

[30] Foreign Application Priority Data

Apr. 28, 1992 [ES] Spain ..... P9200890

[51] Int. Cl.[6] ..... B21C 25/02

[52] U.S. Cl. ..... 72/271; 72/467

[58] Field of Search ..... 72/271, 467

[56] References Cited

U.S. PATENT DOCUMENTS 2,671,559 3/1954 Rosenkranz .
2,894,625 7/1959 Harris et al. .
5,095,734 3/1992 Asher .

FOREIGN PATENT DOCUMENTS 55-3047 1/1980 Japan ..... 72/467

*Primary Examiner*—Lowell A. Larsen
*Attorney, Agent, or Firm*—Herbert L. Lerner; Laurence A. Greenberg

[57] ABSTRACT

A die for extruding solid aluminum profiles having variable thickness is defined with outlets and a bearing length which is constant throughout the profile. The flow of metal into the profile is defined by calculating an angle of entry of the metal at each point of the profile. The angle is a function of a ratio of a perimeter to the thickness of the profile at each point thereof. A feed chamber has at least one step with an interior edge. The interior edge defines the angle relative to the orientation of the profile.

2 Claims, 10 Drawing Sheets

Fig.4a
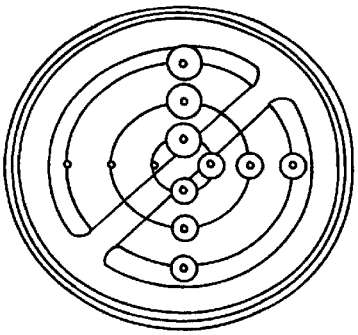
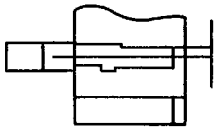
Fig.4b
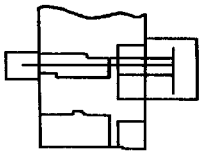
Fig.4c
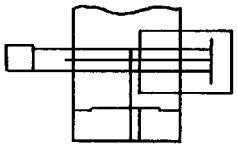
Fig.4d
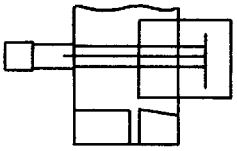
Fig.4e
Fig.5
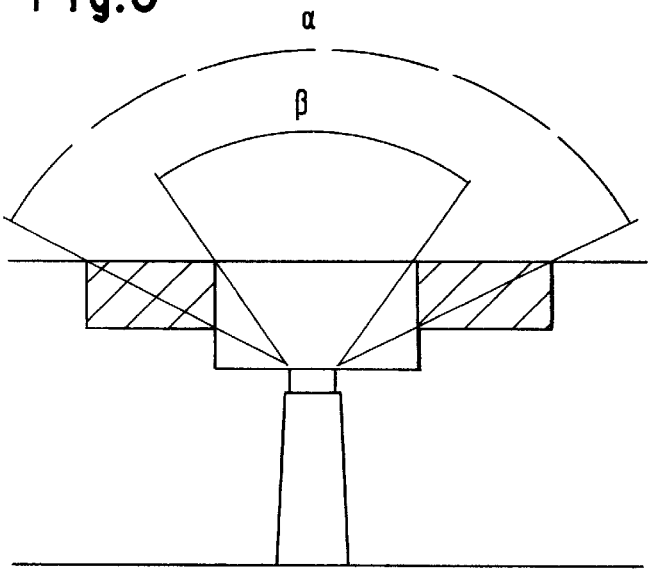
Fig.6a
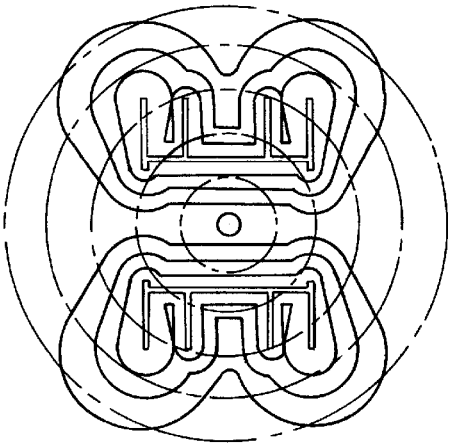

PROCESS AND SYSTEM OF CALCULATION FOR CONSTRUCTION OF DIES FOR EXTRUSION OF SOLID ALUMINUM PROFILES

CROSS-REFERENCE TO RELATED APPLICATION

This application is a continuation of application Ser. No. 08/438,353, filed on May 10, 1995, which is a continuation-in-part of our application Ser. No. 08/047,292, filed Apr. 19, 1993, both abandoned.

BACKGROUND OF THE INVENTION

1. Field of the Invention

The invention pertains to the extrusion of aluminum and to the construction of dies for such extrusion. Aluminum for extrusion purposes can be a commercial high purity grade of aluminum such as EC Alloy, Alloy 1050 or Alloy 1060 (Aluminum Association designations), all containing at least 99.45% by weight aluminum metal with less than 0.4% of alloying constituents such as silicon and iron and 0.05% or less of constituents such as copper, manganese, magnesium, and zinc. More commonly, extruded aluminum shapes are made from higher strength alloys containing 87–98% aluminum and varying small percentages of silicon, iron, copper, manganese, magnesium, chromium, zinc, and/or titanium, for example Alloy 2024, Alloy 5083, Alloy 5086, Alloy 5456, Alloy 6005, Alloy 6053, Alloy 6061, Alloy 6063, Alloy 6101, Alloy X6261, Alloy 6262, Alloy 6351, Alloy 6463, Alloy X7004, Alloy 7075, Alloy 7079, and Alloy 7104.

Detailed chemical compositions of these and similar alloys used for aluminum extrusion can be found in "Handbook of Aluminum"; Alcan Aluminum Corporation (third edition, 1970), pages 148–149. Correlation of these alloy number designation with ASTM specifications, SAE specifications, and federal specifications can be found in the same Handbook at pages 232–236. Correlation of Aluminum Association alloy number designations with designations used in Europe can be found in K. Laue and H. Stenger "Extrusion—Processes, Machinery, Tooling" (translated by A. F. Castle and G. Lang, American Society for Metals, 1981), at pages 128 and 438.

2. Description of the Related Art

In a typical extrusion, a preheated ingot or billet is placed in a hydraulic press and squeezed at high pressure through a steel die so that it emerges from the press in the desired cross section, which can be solid or hollow. Depending on the alloy used, the billet is preheated to a temperature in the range of 420° to 500° C. (in the lower part of the range for high aluminum alloys and higher for alloys with greater amounts of alloying constituents), and partly as a result of frictional heating at the die lands the extrudate exits the die at temperatures ranging from 560° to 600° C.

Traditionally, the extrusion dies for the extrusion of solid aluminum profiles having one or multiple outlets have been constructed with different bearing lengths according to the thickness of the profile and its distance from the center of the die as a way to regulate the flow of the metal and to obtain the correct shape and dimensions.

The bearing surfaces have a braking effect. As summarized by Laue and Stenger (at page 341), the length of the die lands should be at least twice the wall thickness for aluminum sections with a minimum value of 2.5 to 3 mm.

Feed prechambers have also been utilized to insure the coupling or welding between two consecutive extrusions, see Laue and Stenger at page 316.

U.S. Pat. No. 2,895,625 to Harris et al. disclosed a means to correct differences in the rate of flow of metal through different sections of the die orifice which comprises, in combination with such a die, a baffle mounted ahead of the inner face of the die and having an opening in line with and larger than that of each die orifice. The baffle plate is always oriented transversly to the flow of metal. There is no disclosure relating the thickness of the extruded product to the angle of entry of metal into the die.

U.S. Pat. No. 2,671,559 to Rosenkranz disclosed overcoming problems of cracks and fractures occurring under some conditions of operating an extruder, or forging press in his terms. Rosenkranz' solution is to make sure heterogeneous components of the substance of the grain boundaries which are soluble in the mixed crystal (as in alloys) are sufficiently softened but not fused; this is accomplished by operating in a temperature range higher than previously believed desirable. Maintaining the temperature in the desired range, according to Rosenkranz, > " . . . is dependent on, or made possible by, several factors namely the specific pressure of the forging press, the degree of pressing, the initial temperature of the billet, the pressing speed maintained during the pressing operation, and the conicity of the frictional surface of the die also. By using longer and more conical frictional surfaces of the die, more frictional heat is produced than by using short and non-conical pressing tools. (See column 4 lines 56 to 62 and line 73 to column 5 line 1.) Note the linkage of longer and more conical frictional surfaces to temperature control, which is also reiterated at column 5 lines 44 to 58."

> "The heat required for maintaining the temperature difference between the billet and the section is then produced by the heat of friction and deformation the magnitude of which is conditioned by the degree of deformation and the length and conicity of the frictional surface. According to recent discoveries by the inventor the maximal amount of frictional heat is obtained at angles of 2 to 60 between the frictional surface of the die and the direction of pressing. According to the cross sectional area of the section, however, often angles of inclination amounting at least to 1/20 and going up to 120 are possible."

At the same time, the angle of inclination is here stated to be selected independently of the cross sectional area or thickness.

This is confirmed by the following two paragraphs (column 5 line 64 to column 6 line 24) and Table 1 included, where for the extrusion of a flat rod "the angle of inclination of the frictional surface must be smaller on the smaller side than on the wider side" but only the relative magnitudes of the angle are specified for various ratios of the length of the narrow side and broad side of a flat rod. Thus Rosenkranz shows the angle of inclination being varied while the thickness remains the same.

U.S. Pat. No. 5,095,734 to Asher disclosed an extrusion die including a "passageway with a bearing section having parallel bearing surface portions in the direction of extrusion which extend inwardly from an inlet opening a variable distance." Accordingly, the angle of entry is always the same, namely zero, and hence there can be no relationship whatever between the angle of entry and the thickness of the extrudate. Asher's summary of prior art includes drawings and discussion of extruder dies with tapered inlet portions, but no mention of any relationship between the angle of entry and the thickness of the extruded product.

SUMMARY OF THE INVENTION

It is accordingly an object of the invention to provide a process and a system for calculating the layout of dies for the extrusion of solid aluminum profiles, which overcome the hereinafore-mentioned disadvantages of the heretofore-known devices of this general type.

With the foregoing and other objects in view there is provided, in accordance with the invention, a process for constructing a die for extruding solid aluminum profiles having variable thickness, wherein the die has at least one outlet and a bearing length which is constant throughout the profile. The process comprises the steps of defining a flow of metal into the die by calculating an angle of entry of the metal at each point of the profile from a ratio of a perimeter to the thickness of the profile.

In accordance with further modes of the invention, there are also disclosed and claimed the steps of defining a feed chamber through which the metal is fed into the profile, the feed chamber having a shape and a depth determined by the angle of entry of the metal, the angle of entry being defined by an interior edge of at least one step formed in the feed chamber in relation to an orientation of the profile at the at least one step. The angle of entry may be obtained through a graph relating the angle to a distance from a center of the die, the width and depth of the feed chamber, and the feed length.

With the foregoing objects in view there is also provided, in accordance with the invention, a die for extruding a solid aluminum profile having a variable thickness, comprising:

a die body having a prechamber formed therein with at least one step, a bearing length and at least one outlet communicating with the prechamber, the bearing length being constant throughout the profile, and an angle of entry regulating a flow of metal into the profile, the angle of entry being defined at each point of the profile as a function of the ratio of the perimeter to the thickness of the profile.

In accordance with another feature of the invention, the at least one outlet is a plurality of outlets. Furthermore, the at least one step may be a plurality of steps.

We also provide, in accordance with the invention, a die for extruding a solid aluminum profile with a variable thickness, where the die comprises: a die body having an outlet formed therein through which metal is pressed into the profile shape, the body having a prechamber formed therein in communication with the outlet and substantially defining a V-shape pointed towards the outlet, the V-shape being defined with an angle of entry of metal into the profile, the prechamber having at least two different angles of entry at two different locations thereof. The die also has a bearing formed in communication with the prechamber, and the bearing has a constant bearing length throughout the profile.

In other words, we have developed a process for feeding metal into extrusion dies of one or more solid aluminum profiles which makes it unnecessary to use different bearing lengths. Our process provides for construction of extrusion dies for the extrusion of solid aluminum profiles, each die having at least one outlet, in which the bearing length is zero or when present is the same throughout the profile, and the regulation of the flow of the metal is obtained by means of the angle of entry of metal at each point of the profile, the angle ranging from 30 to 180 degrees, calculated as a function of the thickness, distance to the wall of the container, and shape desired for the profile.

Fundamentally, our process consists in determining, by means of graphs or mathematical formulas, the angle of entry of metal to be formed between the profile axis and the width of the feed prechamber or groove etched into the front of the die, for each section of the profile, according to the thickness and distance from the center.

Given that the regulation of the flow of the metal is obtained according to the breadth of the angle at each point, the feed prechambers can be etched in one or several steps, in such a way that the edges of each step define the opening of the feed angle of each point; moreover, with appropriate means of construction, the interior walls of the chamber can be etched with the previously calculated angle.

When it is desired that the profile have a greater metallic thickness, a smaller angle is calculated; when the thickness should be less, a larger angle is calculated.

In these conditions, the metal reaches each point of the section of the profile in appropriate amounts and it becomes unnecessary to use the bearing length as a regulating element of the metal feed; therefore, the bearing length can be zero or, if for convenience of construction there is a bearing length, it shall have the same dimension at all points of the shape or profile to be extruded. Such dimension can be from 0.5 to 20 millimeters.

To determine this feed angle of the metal, we have experimentally determined the amount of the feed which is produced at each point of the die and in relation to the center of the same, with variable angles of entry of metal and according to a parameter which we shall call $\mu$, which measures for each section of the profile the ratio between the area and the perimeter; to do so, the perimeter of the orifice is divided by the area of the same.

Although the invention is illustrated and described herein as embodied in a process and system for calculating dies for the extrusion of solid aluminum profiles, it is nevertheless not intended to be limited to the details shown, since various modifications and structural changes may be made therein without departing from the spirit of the invention and within the scope and range of equivalents of the claims.

The construction of the invention, however, together with additional objects and advantages thereof will be best understood from the following description of the specific embodiment when read in connection with the accompanying drawings.

BRIEF DESCRIPTION OF THE DRAWINGS

FIG. 4*a* is a top-plan view of a prechamber;

FIGS. 4*b*–4*e* are various cross-sectional views taken at different locations on the die blank utilized for testing;

FIG. 5 is a diagrammatic cross-section of a metal entry relative to the extruded length;

FIG. 6*a* is a diagrammatic top-plan view of an extrusion chamber for a type of profile;

DESCRIPTION OF THE PREFERRED EMBODIMENTS

Figure 1A:
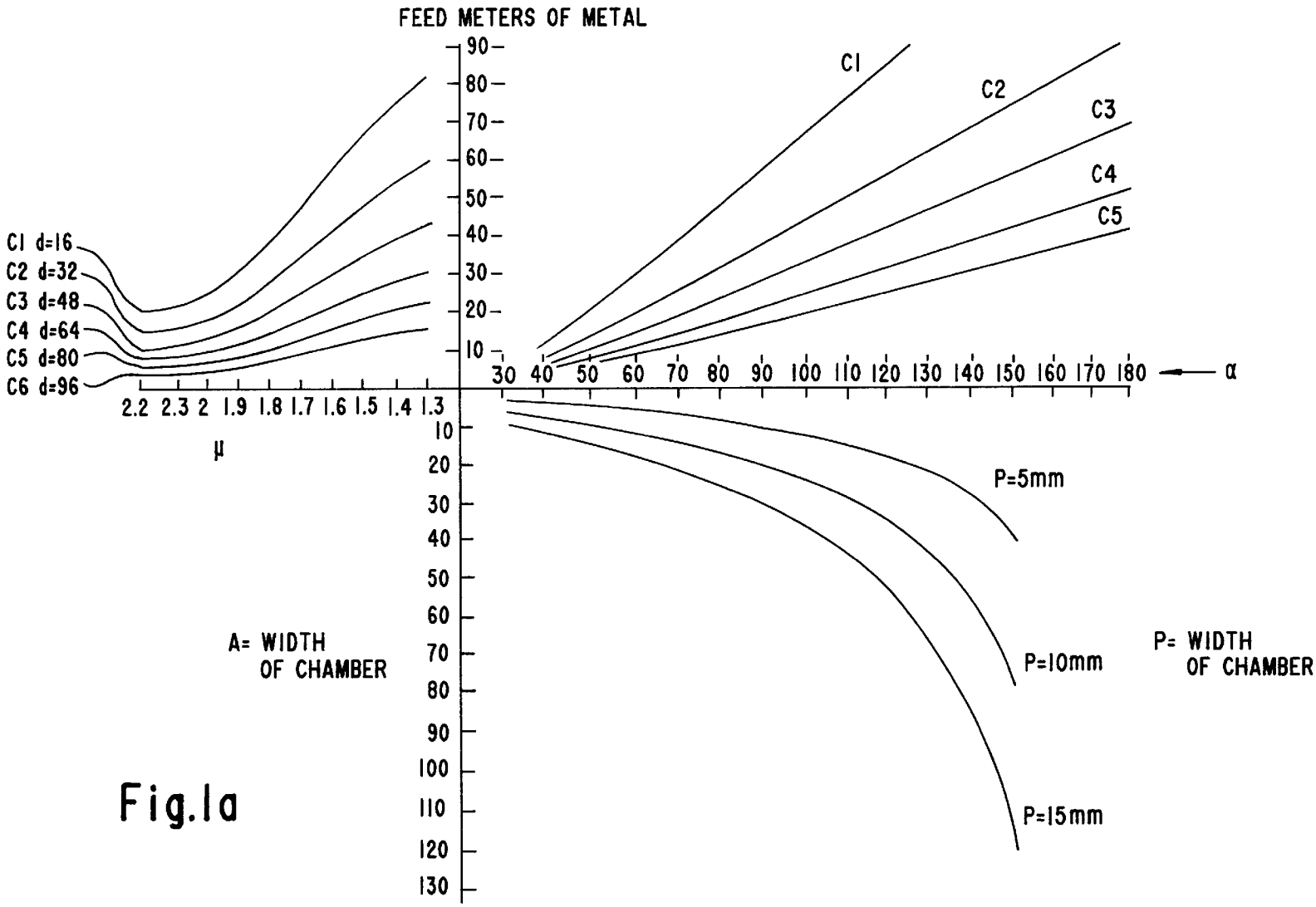
FIG. 1*a* is a triple plot diagram with coordinates representing the calculated die structure.
Figure 1B:
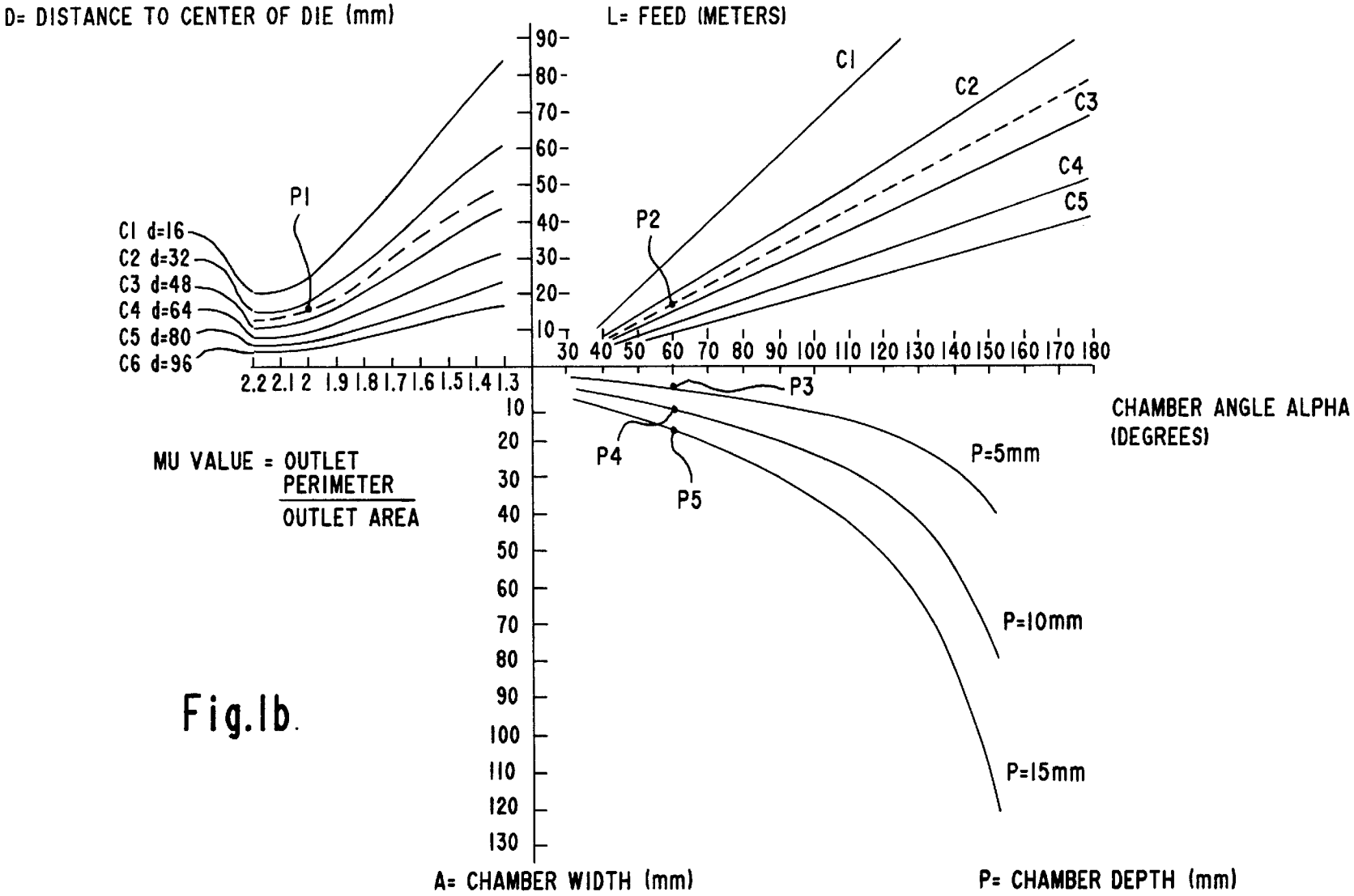
FIG. 1*b* is a similar view with a interpolated dashed lines.

Referring now to the drawing in detail and first, particularly, to FIGS. 1*a* and 1*b* thereof, the above-noted data have been experimentally obtained by constructing a graph shown in the figures which interrelates them, calculating the mathematical expressions which define the curves in the graph. With the results we have established a computer program based on a commercial drafting system, which allows us to plan the die and to obtain on diskette the descriptive record of the CAD (computer assisted drafting), which can then be incorporated into the CAM (computer assisted manufacture) of the machines which construct the die.

FIG. 1*a* represents the coordinates of the graph which is used to construct the die. In this graph, plotted along the horizontal axis or abscissa of the graph beginning at the far left of the upper left quadrant are values, from 2.2 to 1.3 reading from left to right, of the parameter $\mu$ (mu) defined hereinbelow as the ratio of the perimeter to the thickness at a given point along the die; $\alpha$ (alpha) represents the feed angle in degrees, plotted along the horizontal axis or abscissa of the graph beginning at the origin with values increasing from left to right, from 30 to 180 degrees;

L represents the feed measured in meters, plotted along the vertical axis or ordinate of the graph with values increasing upward from the origin, from 10 to 90 meters;

d is the distance, measured in millimeters, from the center of the die to the center of gravity of each subsection, represented by the family of curves C1, C2, C3, C4, C5, and C6 in the upper left quadrant of the graph with the lowest curve C1 for d=96 mm and on up to d=16 mm uppermost;

A represents the width of the chamber, measured in millimeters, plotted along the vertical axis or ordinate of the graph with values increasing downward from zero at the origin to 130;

p is the depth of the chamber, measured in millimeters, represented by the family of three curves in the lower right quadrant of the graph with the upper curve for p=5 mm, the middle curve for p=10 mm, and the lower curve for p=15 mm;

In the upper right hand quadrant of the graph, the straight lines C1, C2, C3, C4, and C5 represent the distance from the center of the die.

FIG. 1*b* is the same graph with addition, in the upper left hand quadrant, of a dotted curve representing d equal to 39.59 mm interpolated between the curves C2 for d=32 mm and C3 for d=48 mm intersecting the vertical axis or ordinate at $\mu$=2, and a dotted horizontal line drawn from that intersection point into the upper right hand quadrant where it intersects the ordinate at angle alpha=60 degrees; and, in the upper right hand quadrant, of a dotted straight line interpolated between straight lines C2 and C3 also intersecting the dotted horizontal line at the ordinate for angle alpha=60 degrees.

Figure 2B:
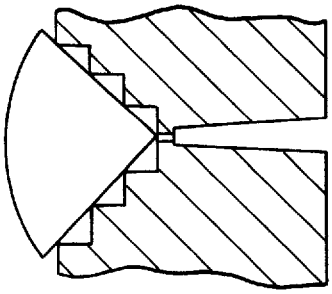
FIG. 2*b* is a partial cross-sectional view through a feed chamber land area.
Figure 2A:
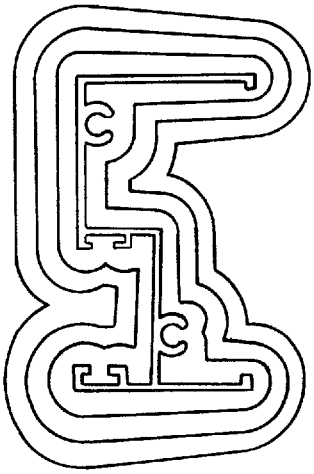
FIG. 2*a* is a top-plan view of a metal forging extrusion die.

FIG. 2*a* is a top view of one of the symmetrical shapes which make up an extrusion die of a metal profile.

FIG. 2*b* is a cross-section representing the shape of the steps in the feed chamber as well as the dimensions which determine the feeding angle, which is formed by the two straight lines passing along the innermost points of the feed chambers to the edge of the profile.

Figure 2C:
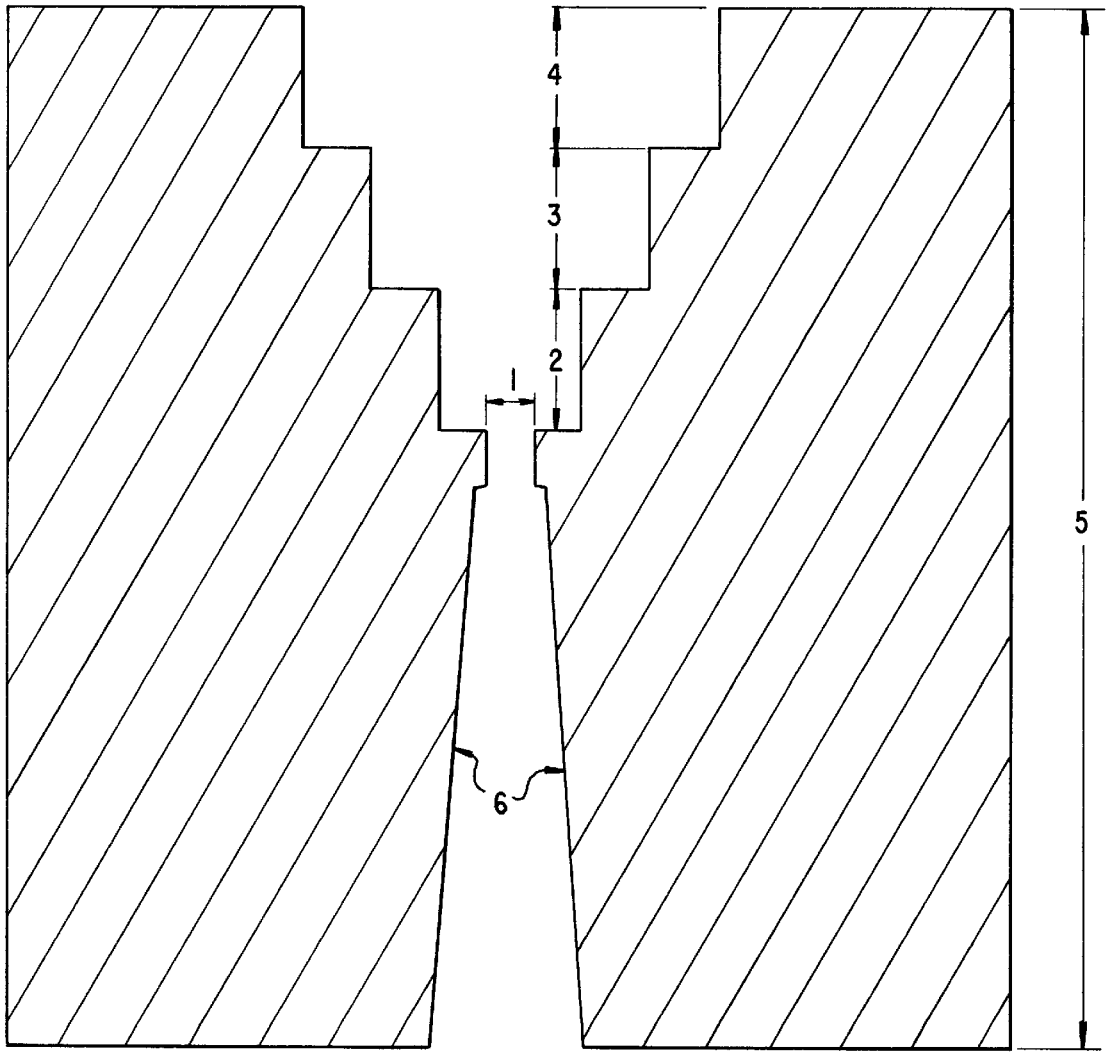
FIG. 2*c* is an enlarged view similar to that of FIG. 2*b;*

FIG. 2*c* is an enlarged rendition of FIG. 2*b* in which the thickness of the profile to be extruded through the die is indicated by the narrowest portion of the opening marked 1 and the bearing length is indicated by the heavy vertical lines on either side of the opening 1; the respective 4 dimensions of the three steps are indicated by 2, 3, and 4; the overall dimensions of the die is indicated by 5; and the walls of the relief zone are indicated by 6.

Figure 2D:
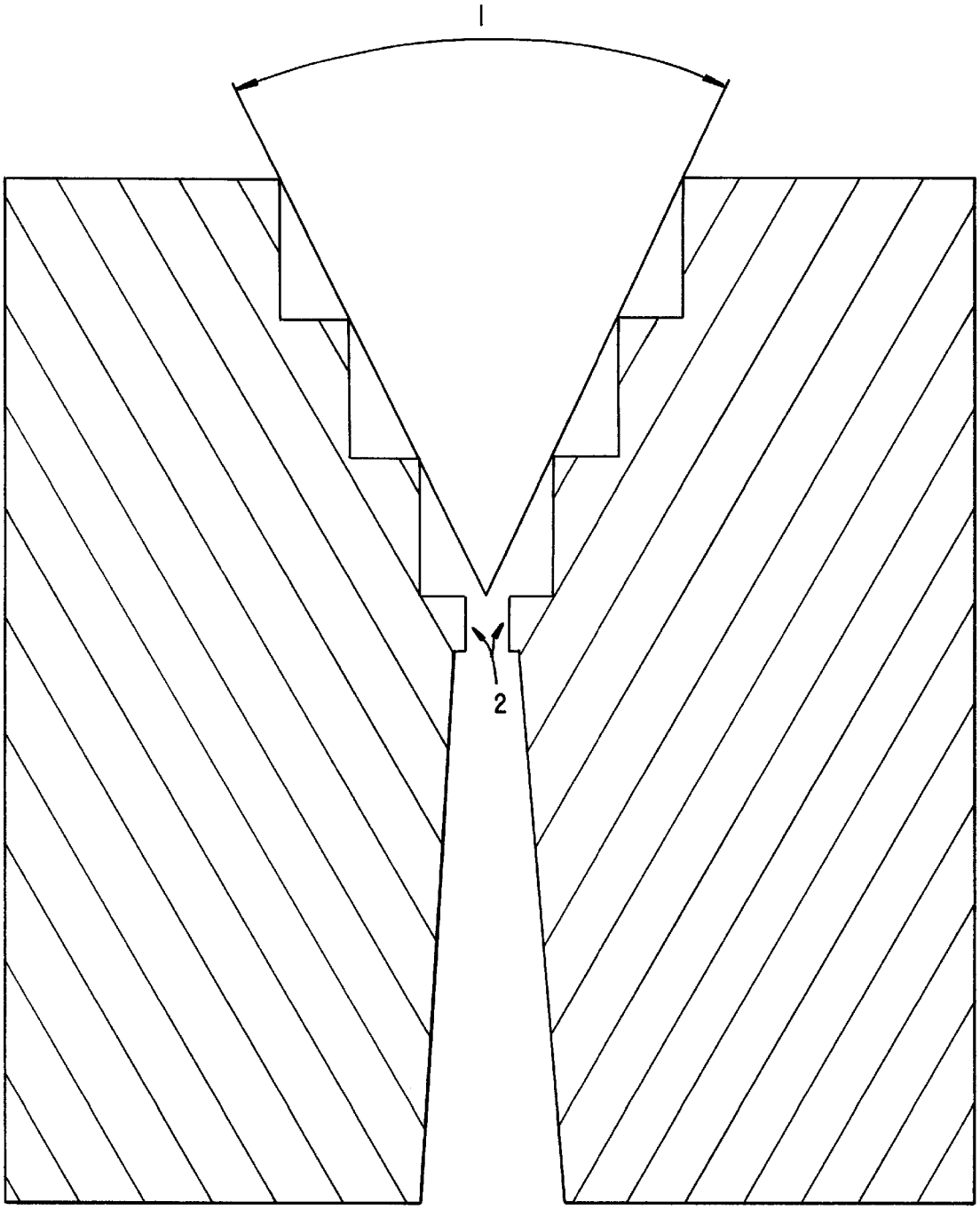
FIG. 2*d* is a similar view as that of FIG. 2*c;*

FIG. 2*d* is a further enlarged rendition of FIG. 2*b* in which the angle of entry 1 is defined by straight lines connecting the corners of the three steps and the bearing length is indicated by the heavy lines at 2.

Figure 3:
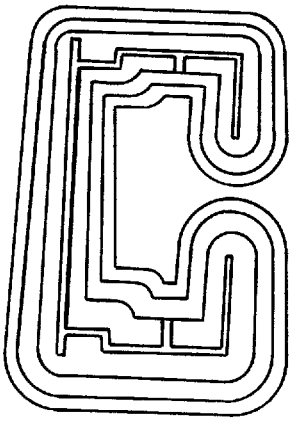
FIG. 3 is a top-plan view of a four-outlet profile.

FIG. 3 is a top view of one of the four symmetrical outlets of a four-outlet profile.

FIG. 4*a* is a top view of the prechamber and the location of the outlets in the experimental process.

FIGS. 4*b*, 4*c*, 4*d* and 4*e* correspond to a transverse section made at different locations on the die blank utilized for tests.

FIG. 5 is a section of a study of the angle of entry of metal in relation to the extruded length. The two angles are labeled $\alpha$ and $\beta$ to illustrate how the size of the angle increases from $\beta$ to $\alpha$ as the radius of the prechamber is increased, or how the radius of the prechamber increases as the angle is changed from $\beta$ to $\alpha$.

FIG. 6*a* is a top view of the extrusion chamber for a type of profile.

Figure 6B:
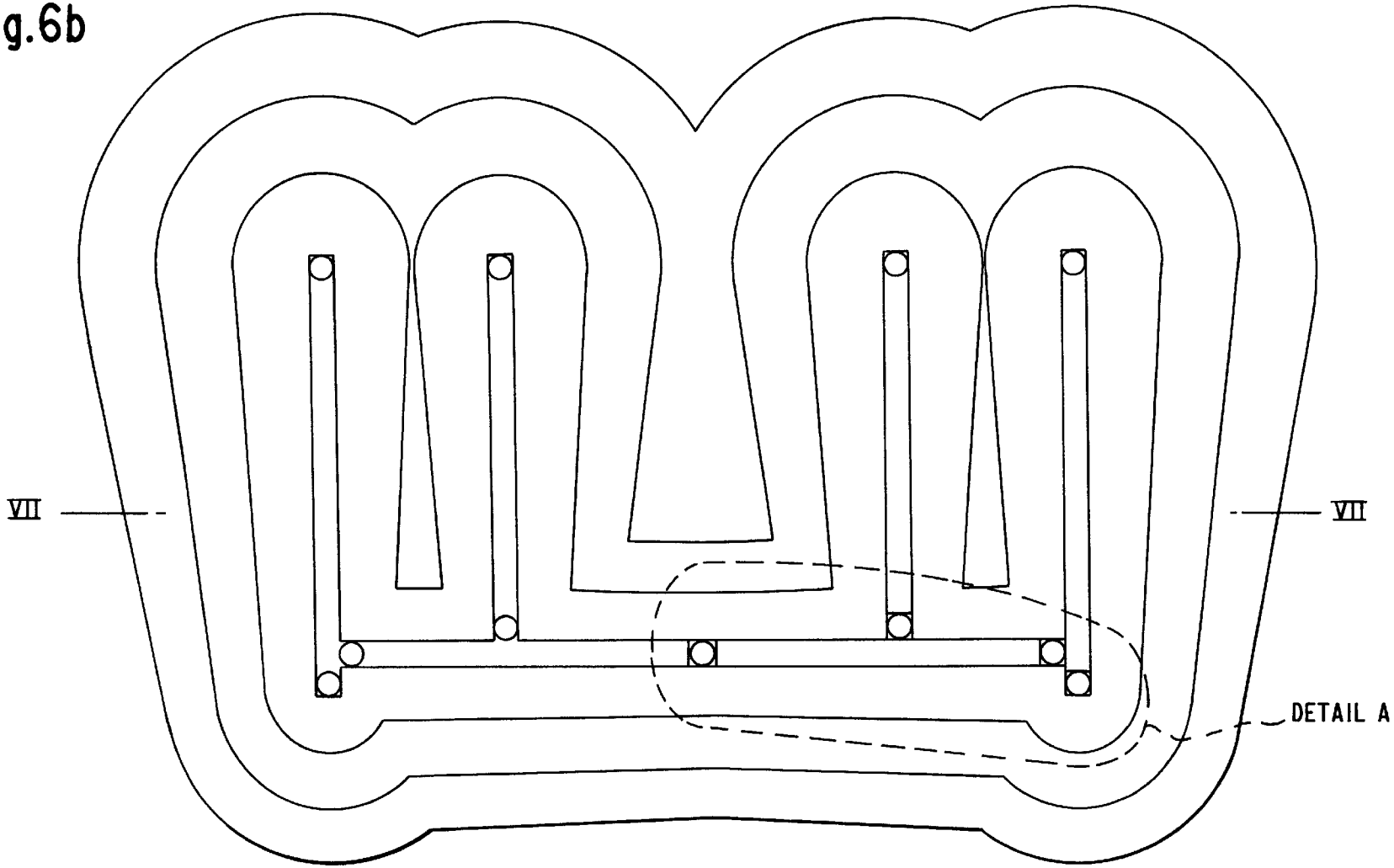
FIG. 6*b* is an enlarged top-plan view of a similar profile.

FIG. 6*b* is an enlarged rendition of the upper half of FIG. 6*a* in which the line VII—VII has been marked to show where a cross-section view has been taken (see FIGS. 7 and 7*a* below) and in which the small circles at the ends and corners of the profile represent subsections to which the calculation of the angle of entry as a function of thickness and distance from the center is to be applied. In the lower right hand portion of FIG. 6*a,* a broken line encompasses an area labeled "detail A" including three such corner subsections.

Figure 6C:
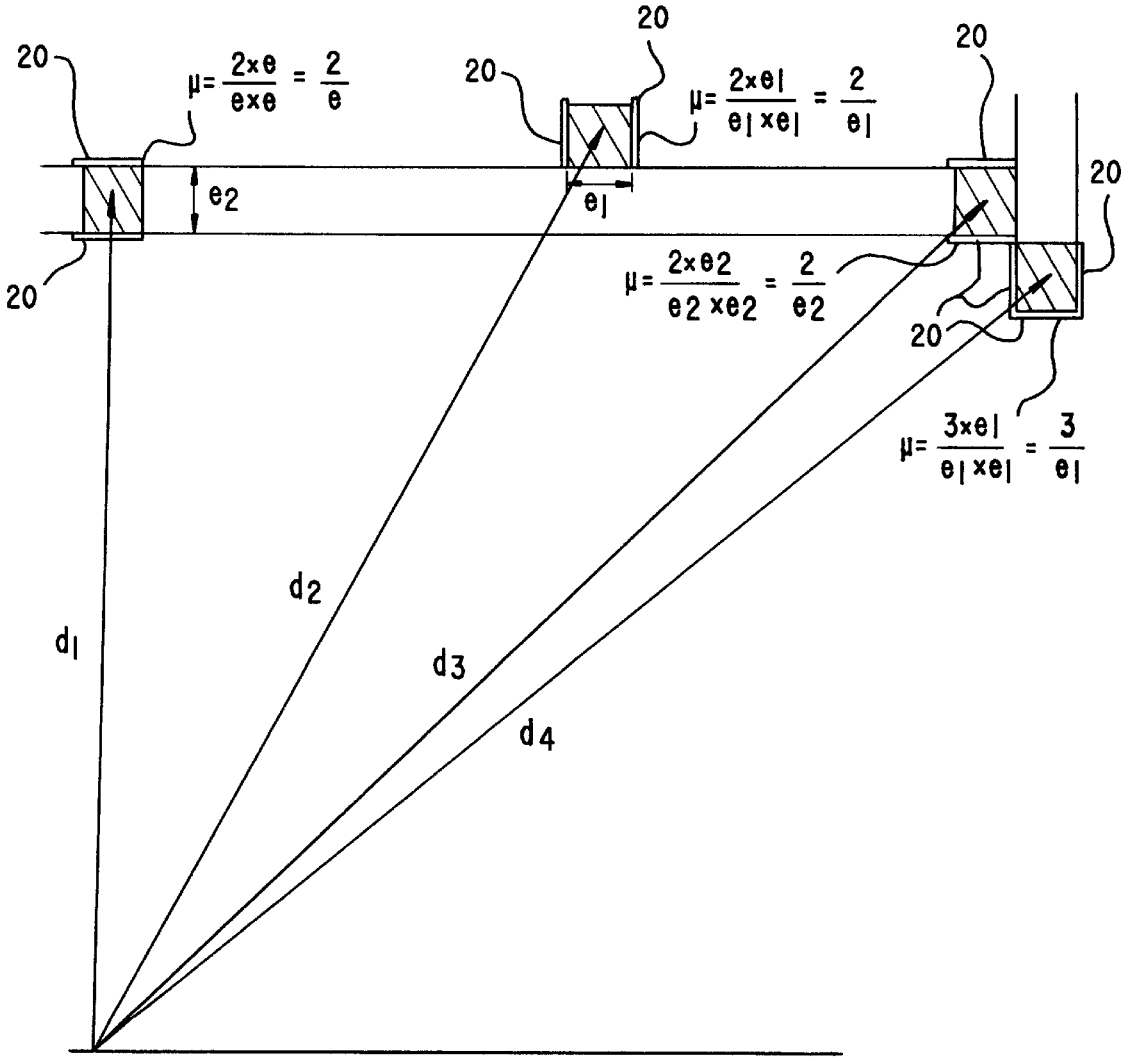
FIG. 6*c* is a further enlarged view of detail A of FIG. 6*b;*

FIG. 6*c* represents a further enlargement of the portion "detail A" of FIG. 6*b,* in which e1, e2, e3 represent the thickness of each subsection and heavy lines are used to represent the perimeter 20 of each subsection in contact with a bearing surface. Straight lines d2, d3, d4 show the distance of the center of each subsection to the center of gravity of the die (beyond the lower left corner of the diagram, not shown). Also shown for each subsection is the calculation of the value of $\mu$ as the ratio of the perimeter to the thickness.

Figure 6D:
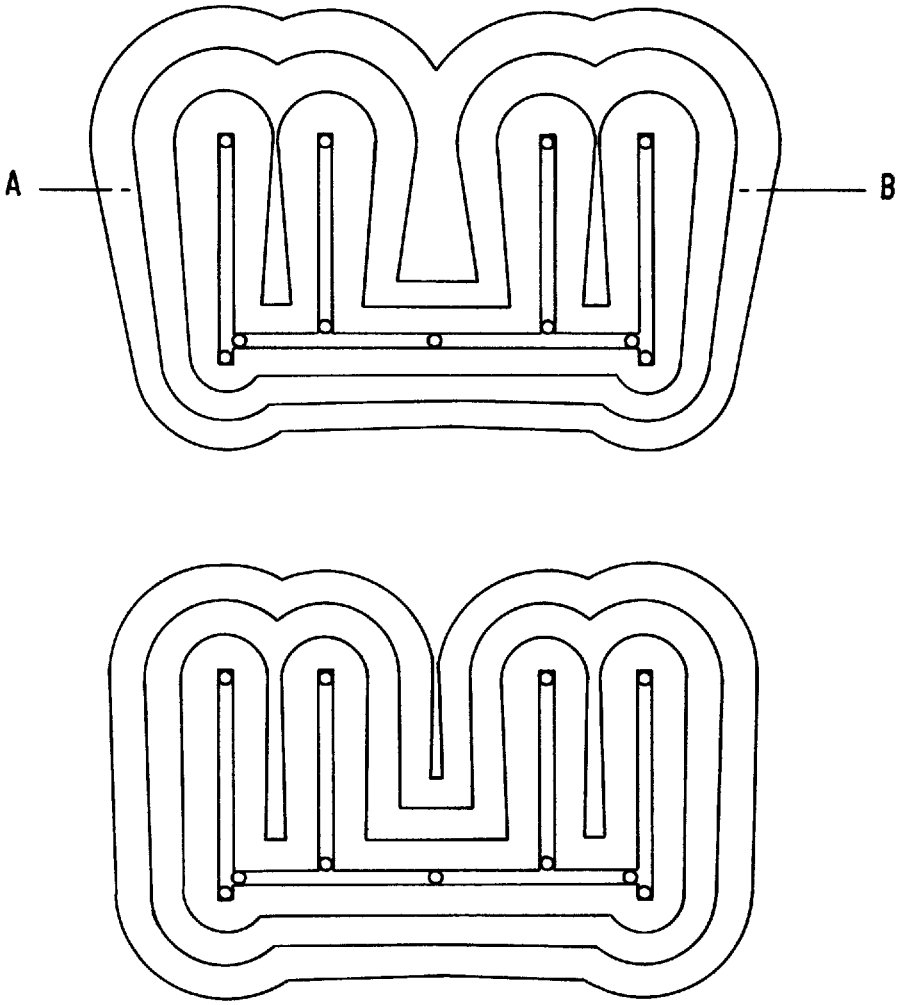
FIG. 6*d* shows a comparison between two different layouts regarding the prechamber angles.

FIG. 6*d* illustrates that difference between two extrusion systems for one and the same extrusion profile.

Figure 7:
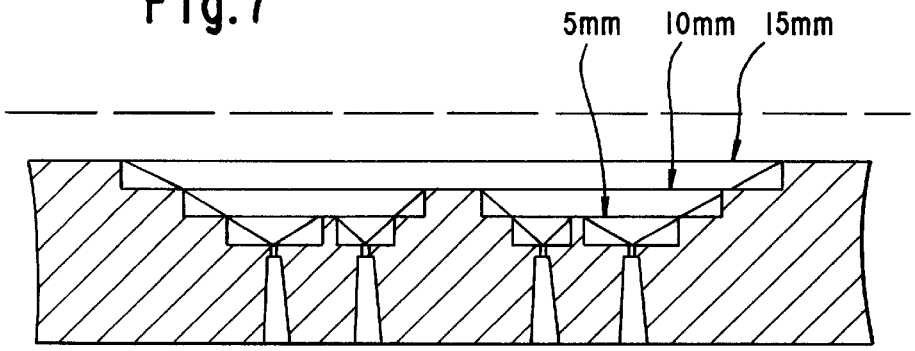
FIG. 7 is a cross-sectional view taken along line VII—VII in FIG. 6*b;*

FIG. 7 is a cross-sectional view taken along the line VII—VII of FIG. 6*b*. FIG. 7 indicates the height of the three steps as 5 mm, 10 mm, and 15 mm, respectively, from the start of the bearing length.

Figure 8:
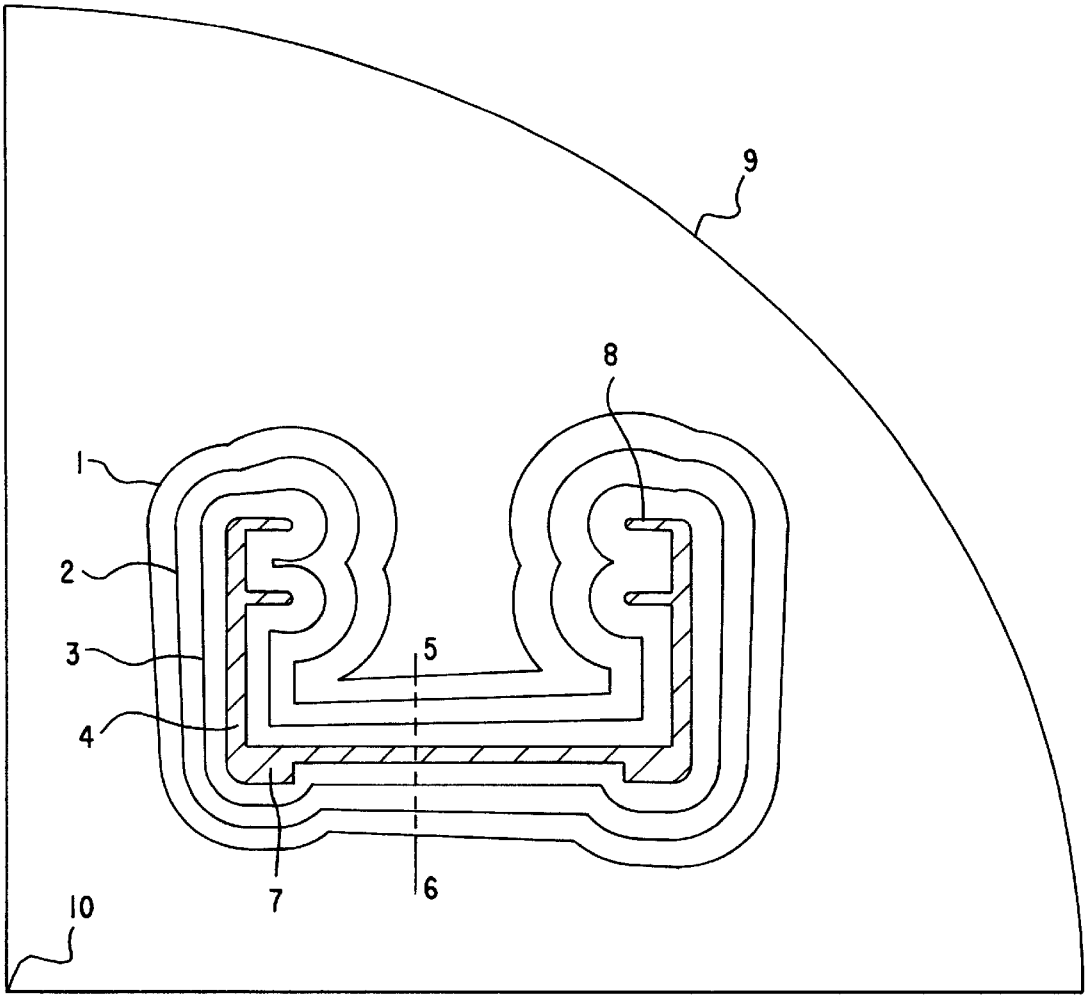
FIG. 8 is a plan view of a quarter die according to the invention.

FIG. 8 is a top view of a die with three step prechamber for extruding profile 4 shown shaded, in which 1 is the contour of the prechamber step 15 mm above the start of the bearing, 2 is the contour of the step 10 mm above the start of the bearing, 3 is the contour of the step 5 mm above the start of the bearing, the straight line from 5 to 6 identifies a cross-section through the steps and the angle of entry, 7 and 8 represent points along the profile with thickness=5 and 1 respectively, 9 represents the edge of the die, and 10 represents the geometrical center of the die.

To calculate the feed chambers of dies with the same bearing length throughout, a series of tests was conducted for the purpose of quantifying the variables which intervene in the design and correction of the dies with feed prechamber and a single bearing length. We will consider in this first part only solid dies and we will attempt to reflect the sequence of our tests.

We had a 2,000 MT extrusion press with a 200 mm diameter container and a small extrusion press for wax, with a container of 200 mm diameter and 300 meter length.

We tested different compositions of wax before obtaining a flow similar to that of aluminum with a normal die, comparing the behavior of the points of the profile in both extrusions.

In a die, we constructed twelve outlets with 6 mm diameter and 3 mm bearing length in three concentric circles, situating them on four perpendicular radii (as shown in FIG. 4)

We used the first series of outlets, with no prechamber, as a reference sample.

In the second series, with the same bearing length and rod diameter, we arranged at the entrance a prechamber with 20 mm diameter and 10 mm deep.

The separation between prechambers is sufficiently great for no interferences to be produced in the flows of the wax.

In the third series of outlets, with the same prechamber diameter, we increased the depth to 15 mm, maintaining the same bearing length and diameter.

In the fourth series of outlets, we maintained the same depth of 15 mm for the prechamber and increased the diameter to 26 mm.

After a series of tests and comparing the results, we reached the conclusion that in each concentric circle around the center of the die, the feed and, therefore, the extruded length varied with the angle of entry (&) of metal which forms between the diameter of the outlet.

Repeating the tests with aluminum and measuring the lengths of extrudate which flow through each outlet, we reach the following conclusions:

—For the same angle of entry, the extruded length is less depending on how far away the outlets are from the center of the die.

—For similar angles of entry, there is similarity in the extruded lengths between orifices located at equal distances from the center of the die.

—Upon increasing the depth of the chamber with the diameter constant, the flow of the metal diminishes.

—Maximum feed is obtained when there is no prechamber, which in theory is equivalent to an entry angle (&) of 180°.

In view of these conclusions, we decided to quantify the results, and for this the possible variables and the test alternatives are:

| TEST NO. | 1 | 2 | 3 | 4 |
|---|---|---|---|---|
| Distance from the center of the die | variable | fixed | fixed | fixed |
| Angle of entry of the metal | fixed | variable | fixed | fixed |
| Thickness of the profile | fixed | fixed | variable | fixed |
| Bearing length in the outlet | fixed | fixed | fixed | variable |

After having conducted tests 1, 2 and 3 and quantified the parameters, with the results obtained we have constructed a diagram for calculating the dimensions of the die. This diagram is FIG. 1 of the accompanying drawings.

The operative form for the calculation is as follows:

Based on the shape of the die which we wish to design and using as a basis a circle of 85% of the diameter of the container which we intend to utilize for the extrusion, we distribute the number of intended outlets in relation to the centers of gravity of the figure, coinciding with the centers of gravity of the parts of the circular sector which they occupy.

Next, we draw 16 mm concentric circles centered on the center of the die. We number the circles where they intersect the profile or section of various profiles at actual size, starting with those closest to the center of the die.

We next calculate the value of $\mu$ (mu) for every point of intersection, by dividing the perimeter in contact with the bearing surface of the profile of a section of equal length (measured in millimeters) by the thickness of profile at that point which is the cross-section area in square millimeters. Accordingly, the dimensions of $\mu$ are mm-1 (reciprocal millimeters). Thus the value of $\mu$ defines the shape and thickness factor of each point of the profile.

We then prepare a Table of Values as follows

Point No.-Circle no.-m value-feed-prechamber depth-prech. width

1

2

3 etc.

and enter the numbers of the respective circles and $\mu$ values already obtained. The data needed to complete the table are then obtained from the graph of FIG. 1*a*. We enter the value of $\mu$ on the abscissa (horizontal or X axis) of the upper left quadrant of the graph where the values of $\mu$ are plotted. Moving up vertically we seek the intersection of the curve defining the distance from our point to the center of the die (selecting from the family of curves the one that corresponds to that distance or interpolating between curves if necessary). A horizontal through that intersection point then reads from the right hand scale the value representing the feed rate at that point, which we enter in the Table. FIG. 1*b* illustrates an actual example of how that is done.

Doing the same for all the points chosen along the face of the profile, we find the point with the minimum feed rate i.e. the point along the shape where extrusion is most difficult. That feed is applied to all points of the profile to obtain a uniform flow of metal all along the profile.

The next step is calculating, with this reference feed, the angle of entry at each point along the profile as a function of it's distance from the center of the die. Thus we follow horizontally in the upper right quadrant of the graph from the reference feed rate read on the vertical scale to the intersection with the line from the family of lines C1, C2, C3 etc, which defines the distance from the center of the die to the particular point. A vertical from that intersection then reads on the horizontal scale in the center of the graph the angle yielding this feed to be cut at the entrance to this point on the shape of the die.

To calculate the widths of the three feed pre-chambers cut into the die (in our experience three pre-chambers in steps each 5 mm deep provide inexpensive construction and precisely define the angle of entry), we use the lower right quadrant of the graph. We start with the feed angles found for each point along the profile, move down vertically to the respective intersections with the curves for P=5 mm, P=10 mm, and P=15 mm, and read the widths of the pre-chambers on the vertical scale at the left of the lower right quadrant. With this information we can complete the table.

Once the table is completed, we draw a circle of the calculated diameter around each point selected. Then, by connecting these circles by tangent straight lines we have the outline of the contour of the prechamber in its final shape in a mathematically precise manner.

When it is impossible due to the geometry of the figure to construct the prechambers with the calculated widths because they interfere, we have two possible solutions:

—In the first, if the value of $\mu$ is very close from some points to others, we select the maximum diameter that we can trace on the critical parts of the figure without two continuous ones interfering and we use the graph in the opposite sense to calculate the maximum feed which this prechamber allows. Then we reconstruct the rest of the prechambers, using this maximum feed as a basis, by moving through the graph from the feed rate to the straight lines C1, C2, C3, C4, C5, etc to read the necessary angle from the horizontal scale at the center of the graph. This way, we obtain a die with less feed, but balanced.

A second possibility, for dies which have variable $\mu$ values, consists in superposing feed chambers with different depths in such a way that, even of the circles of the large chamber interfere, other chambers appear at less depth, with less diameter and lesser depth.

Up to now we have tested dies with a maximum bearing length of 2 mm and in some cases with zero bearing length, sharpening the bearing at an accelerated angle of 3° (i.e. tapered inward by 3°) and obtained useful dies that allowed us extrusion rates of up to 80 m per minute in all cases.

EXAMPLE 1

In FIG. 2*a* appears a top view drawing of one of the two symmetrical figures making up a die of a profile intended for construction of a window. On the drawing of the three steps which have been etched to adapt to the feed angle, the feed angles calculated with the aid of the graph are depicted. Throughout the figure, the bearing length is 2 mm.

The shape of the steps in the feed chamber as well as the dimensions which determine the feed angle, variable for each point of the die, are specified in detail in the cross-sectional view of FIG. 2*b*. It can be seen that the three steps are wider on the left of the cross-section and narrower on the right, resulting in a greater angle from the vertical on the left and a smaller angle from the vertical on the right.

This die has been etched on an H-13 steel disk and after being tempered and adjusted it was used in the manufacture of profiles, producing a profile of correct dimensions and shapes within tolerances and with an extrusion rate of 60 m per minute.

EXAMPLE 2

In FIG. 3*a* there is a top view drawing of one of the four symmetrical outlets of a profile intended for tracks for vertical blinds.

As in the preceding case, there is a top view drawing of the three steps which, contouring the profile, define the feed angle of the prechamber which supplies aluminum to each point of the profile to the extent necessary to regulate its output and to obtain correct shapes and dimensions.

The bearing length which makes up the shape of the profile is 1.5 mm throughout the figure.

The feed angles have been calculated with the aid of the graph in FIG. 1.

The cross-section of the steps in the prechamber which determine the feed angle calculated for each point of the profile appear drawn in FIG. 2*b*.

This four-outlet die has been constructed in H-13 type steel, tempered and rectified and extruded in a horizontal press for aluminum of 1,600 MT, producing from the start aluminum profiles of very good quality, with correct dimension tolerances and surface finish at a rate of 65 m per minute.

EXAMPLE 3

This Example illustrates the use of our graph (FIG. 1*a* and FIG. 1*b*) to derive the design parameters for the lower right corner subsection in the profile of FIG. 6*a* and FIG. 6*b*

The value of $\mu$ was calculated as the ratio of the perimeter of the subsection in contact with bearing surface to the area of the subsection. With the thickness of the subsection e equal to 1.5 mm, the area of the subsection was 1.5 mm×1.5 mm=2.25 $mm^2$; the perimeter was 3×1.5 mm=4.5 mm and m=4.5 mm/2.25 $mm^2$=2 $mm^{-1}$ The distance from the center of gravity of the subsection to the center of the die was 39.59 mm, which is between curves C2 (32 mm) and C3 (48 mm) in the graph. Interpolation in the graph (upper left hand quadrant of FIG. 1*b*) gave the dotted curve intersecting the ordinate for $\mu$=2 at the point marked P1. Moving horizontally to the right from P1 intersected the feed ordinate at feed L=16 meters.

In the upper right hand quadrant of the graph, a straight line corresponding to distance d=39.59 mm interpolated between C2 and C3 intersected the horizontal through P1 and L=16 at a point P2. Moving vertically down from P2 intersected the angle abscissa at a chamber angle of 60 degrees. Continuing to move vertically down from P2 intersected the chamber depth curves for 5 mm, 10 mm, and 15 mm at points P3, P4, and P5 respectively. Moving left from each of the points P3, P4, and P5 to the chamber width ordinate at the edge of the lower right quadrant intersected the latter at chamber widths A=6, 12, and 18 mm respectively.

We claim:

1. A process for constructing a die for extruding solid aluminum profiles having a variable thickness, wherein the die has at least one outlet and a bearing length which is constant throughout the profile, which process comprises:

defining a feed chamber, communicating with at least one outlet, through which metal is fed into a profile, the feed chamber having a feed length, a shape, and a depth determined by an angle of entry of the metal, the angle of entry being defined by an interior edge of at least one step formed in the feed chamber in relation to an orientation of the profile at the at least one step; and defining a flow of the metal into a die by calculating the angle of entry of the metal at each point of the profile from a graph relating the angle of entry to a ratio of a perimeter to the thickness of the profile, a distance from a center of the die to a center of gravity of the profile, the width and depth of the feed chamber, and the feed length.

2. The process according to claim 1, wherein the bearing length is within a range of 0.5 to 2 mm.

* * * * *